United States Patent [19]

Harris

[11] 4,441,402

[45] Apr. 10, 1984

[54] AESTHETIC ACOUSTICAL AIR DISTRIBUTION DUCT SYSTEM

[75] Inventor: David A. Harris, Sylvania, Ohio

[73] Assignee: Owens-Corning Fiberglas Corporation, Toledo, Ohio

[21] Appl. No.: 429,919

[22] Filed: Sep. 30, 1982

Related U.S. Application Data

[63] Continuation of Ser. No. 260,240, May 4, 1981, abandoned.

[51] Int. Cl.[3] ..... F24F 7/06

[52] U.S. Cl. ..... 98/40 C; 98/40 D; 98/DIG. 10

[58] Field of Search ..... 98/40 C, 40 D, DIG. 10; 181/224, 295

[56] References Cited

U.S. PATENT DOCUMENTS

| | | | |
|---|---|---|---|
| 1,550,714 | 8/1925 | Stacey, Jr. | 98/40 C |
| 2,704,864 | 3/1955 | Miles | 181/295 X |
| 3,092,529 | 6/1963 | Pearson . | |
| 3,212,529 | 10/1965 | Ullman et al. | 138/141 |
| 3,308,743 | 3/1967 | Waeloner et al. | 98/40 C |
| 3,513,065 | 5/1970 | Pearson . | |
| 3,515,052 | 6/1970 | Branides | 98/40 C X |
| 4,034,826 | 7/1977 | Andrews | 98/DIG. 10 X |
| 4,286,419 | 9/1981 | Treffers | 98/40 D X |

FOREIGN PATENT DOCUMENTS

| | | | |
|---|---|---|---|
| 2155051 | 5/1973 | Fed. Rep. of Germany | 98/40 C |
| 534283 | 3/1922 | France | 98/40 C |

*Primary Examiner*—Albert J. Makay
*Assistant Examiner*—Harold Joyce
*Attorney, Agent, or Firm*—Ronald C. Hudgens; Philip R. Cloutier; Paul J. Rose

[57] ABSTRACT

The duct system includes rectangular duct sections suspended from a ceiling of a room, discharging conditioned air from the top, and being formed of fabricated acoustical fibrous board sound absorbent with respect to sounds emanating from sources in the room outside of the duct sections.

4 Claims, 7 Drawing Figures

AESTHETIC ACOUSTICAL AIR DISTRIBUTION DUCT SYSTEM

This is a continuation, of application Ser. No. 260,240, filed May 4, 1981 now abandoned.

TECHNICAL FIELD

This invention relates generally to air distribution duct systems, and more particularly to duct systems for providing air conditioning in existing buildings not originally having air conditioning systems.

BACKGROUND ART

U.S. Pat. No. 3,353,472 discloses an air distribution duct system having rectangular duct located in a plenum above a dropped ceiling. U.S. Pat. No. 3,478,667 discloses an air distribution duct system having circular duct suspended from a ceiling, discharging from the top, and having a steel jacket.

DISCLOSURE OF INVENTION

In accordance with the invention, an air distribution duct system is provided which has rectangular duct suspended from a ceiling, discharging from the top, and including a decorative porous fabric jacket over acoustical fibrous glass board. The arrangement of the duct in a grid pattern also enhances acoustical performance.

BRIEF DESCRIPTION OF DRAWINGS

This invention is hereinafter described in more detail with reference to the accompanying drawings in which.

BEST MODE OF CARRYING OUT THE INVENTION

Figure 1:
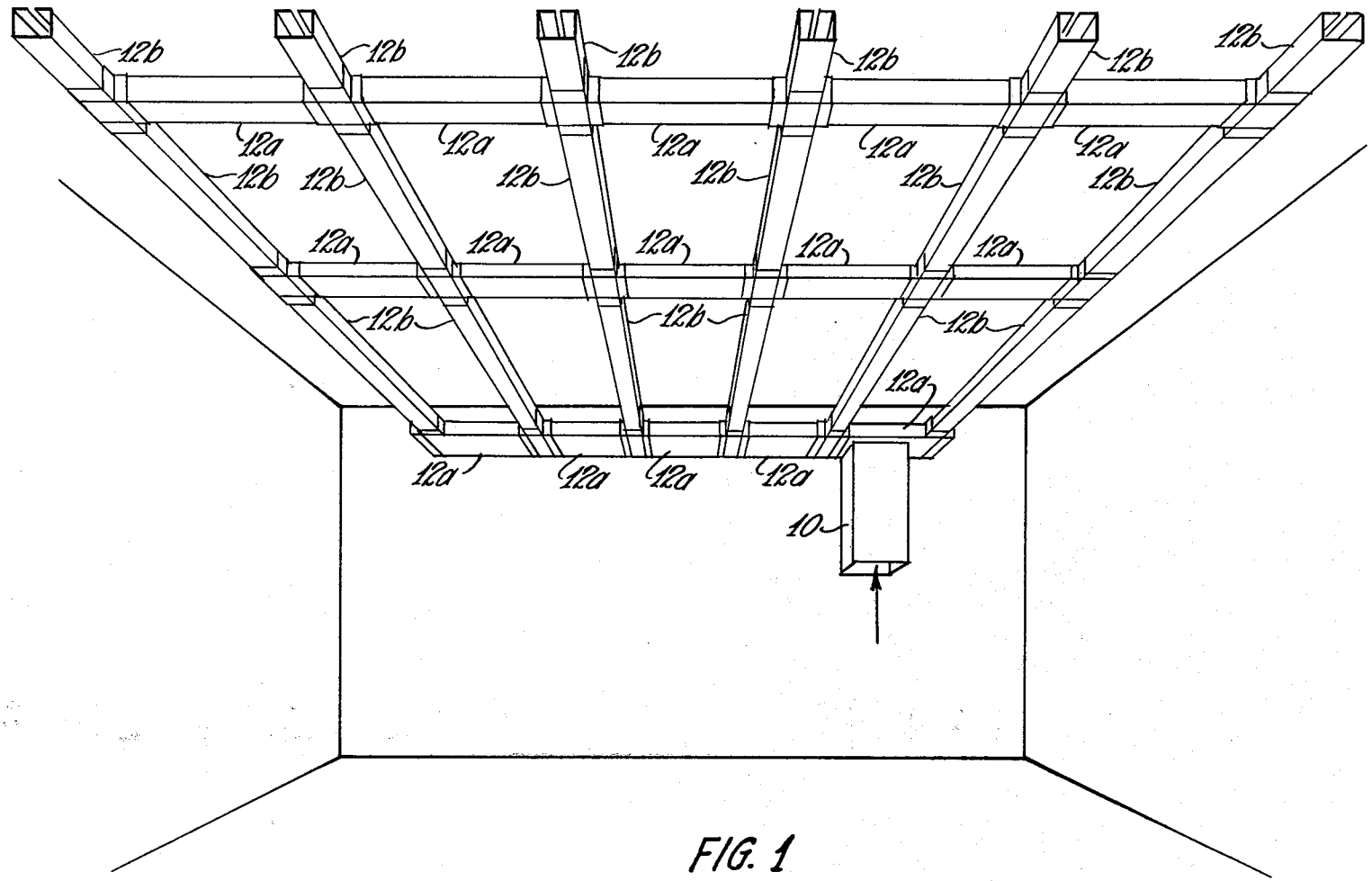
FIG. 1 is a fragmentary perspective view of a room having an air distribution duct system constructed in accordance with the invention.

With respect to the drawings, FIG. 1 shows a portion of a room having an air distribution duct system exemplary of the invention and including a main supply duct 10 supplying air to a duct grid. The duct grid includes a plurality of duct sections 12*a* extending in a first direction and a plurality of duct sections 12*b* extending in a second direction perpendicular to the first direction. The duct sections 12*a* and 12*b* are rectangular in cross section and the upper wall portions thereof are slotted lengthwise of the duct as shown more clearly for the duct sections shown in FIGS. 2–6.

Figure 2:
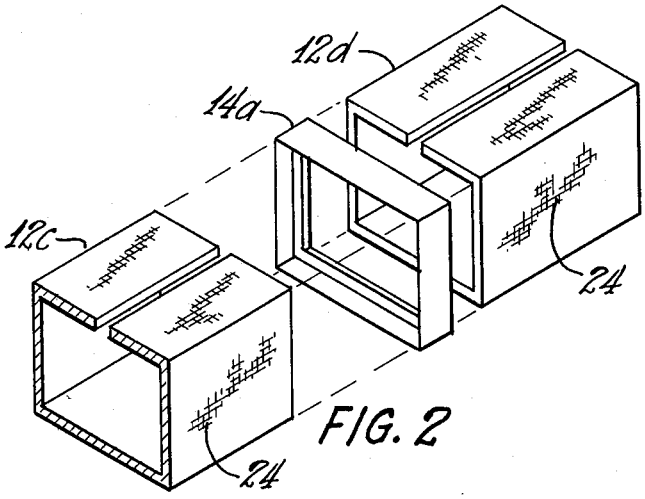
FIG. 2 is a fragmentary exploded perspective view illustrating a straight connection between two sections of duct in a duct system constructed in accordance with the invention.

FIG. 2 shows portions of two duct sections 12*c* and 12*d* and a fitting 14*a* for a straight connection therebetween. The fitting 14*a* is shown as an outer sleeve which is adapted to receive end portions of the duct sections, but it will be understood that an inner sleeve would work just as well. The fitting 14*a* is preferably made of metal or plastic.

Figure 3:
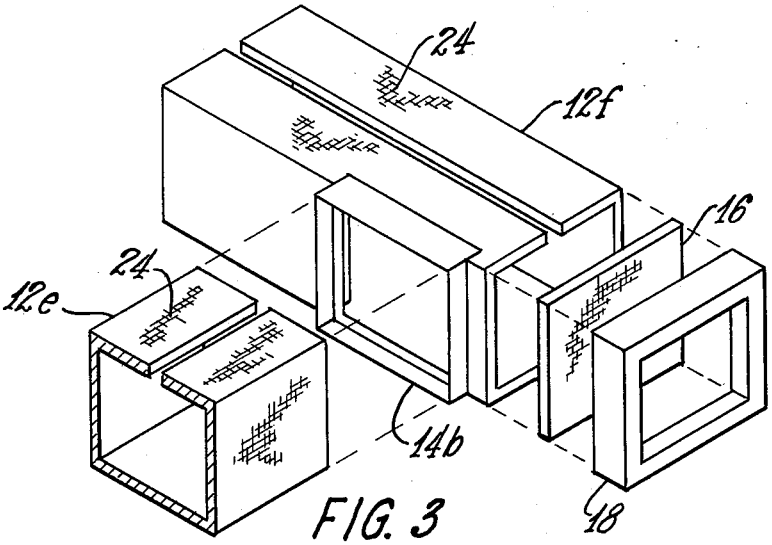
FIG. 3 is a fragmentary exploded perspective view illustrating a right-angle connection between two sections of duct in a duct system constructed in accordance with the invention.
Figure 4:
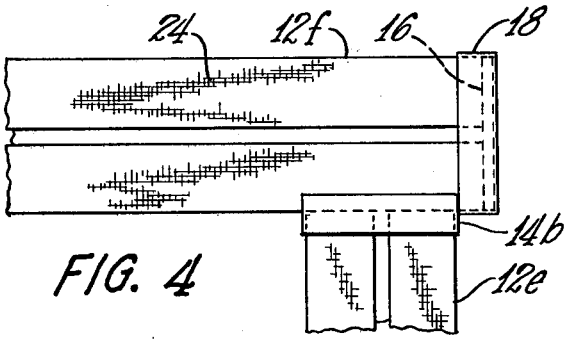
FIG. 4 is a plan view of the duct sections of FIG. 3 in a connected state.

FIG. 3 shows portions of two duct sections 12*e* and 12*f* and a fitting 14*b* for a right-angle connection therebetween. A sidewall portion of the duct section 12*f* is cut away to receive the fitting 14*b* and thereafter the duct section 12*e* is inserted in the fitting 14*b*. A plug member 16 plugs an end of the duct section 12*f* and is held in position by a cap 18. The assembled relationship is shown in FIG. 4.

Figure 5:
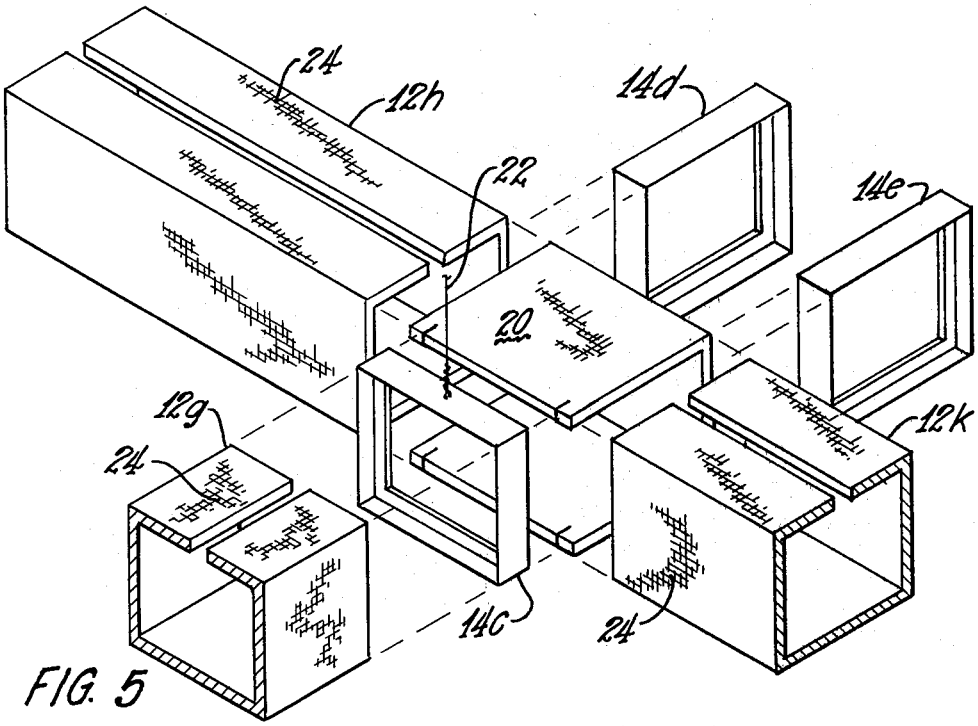
FIG. 5 is a fragmentary exploded perspective view illustrating a tee connection between three sections of duct in a duct system constructed in accordance with the invention.
Figure 6:
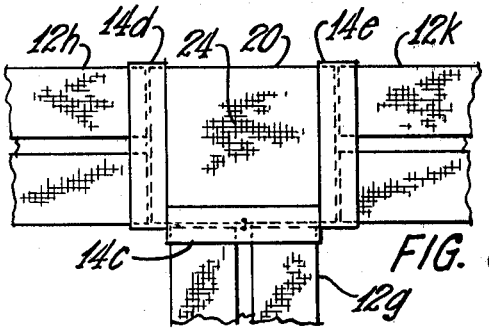
FIG. 6 is a plan view of the duct sections of FIG. 5 in a connected state.
Figure 7:
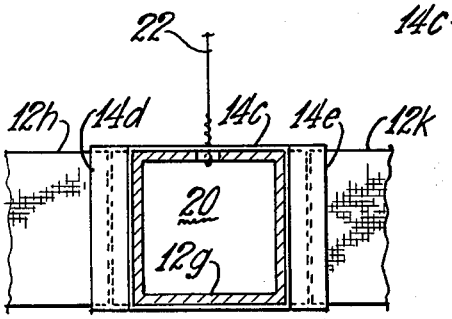
FIG. 7 is an elevational view of the duct sections of FIG. 6.

FIG. 5 shows portions of three duct sections 12*g*, 12*n*, and 12*k* and three fittings 14*c*, 14*d*, and 14*e* for a tee connection therebetween. On one side the fittings receive respective portions of a U-shaped connection member 20 and on the other side they receive the respective duct sections. The assembled relationship is shown in FIGS. 6 and 7. The duct system can be suspended by wires attached to the fittings and to suitable hooks (not shown). One such wire 22 is shown in FIGS. 5 and 7. For a four-way connection, the bight portion of the U-shaped connection member 20 is removed and an additional fitting is provided like the fittings 14*c*, 14*d*, and 14*e*.

The board from which the duct sections are made is preferably formed of mineral fibers such as glass fibers held together by a suitable binder such as phenolformaldehyde in an amount of about ten percent by weight. Because the duct should be fairly rigid, the board is compressed before curing of the binder to a density preferably of about six pounds per cubic foot and is made in a thickness of about one to three inches. The side of the board which becomes the outer side of the duct is shown as being faced with decorative porous fabric, preferably glass cloth, such as indicated at numeral 24 on various duct sections. Alternatively, the facing may be a plastic film or a coat of paint. The inner side of the board is cut away in a grooving machine to provide grooves for folding of the board into a rectangular hollow duct, somewhat as in FIGS. 2 and 3 of U.S. Pat. No. 3,212,529, but with four grooves for the folding of the board at the four corners of the duct and the forming of the slot in the upper wall portion of the duct between opposite edge portions of the board. If desired, aluminum foil may be provided on the inside of the duct sections to prevent too much diffusion of air through the duct walls.

Various modifications may be made in the structure shown and described without departing from the scope of the invention.

I claim:

1. An air distribution duct system suitable as a retrofit air distribution system for a room of an existing building and also providing an aesthetic acoustical treatment for a ceiling of the room, the system comprising a plurality of parallel duct runs extending in a first direction and a plurality of parallel duct runs extending in a second direction perpendicular to the first direction, the duct runs extending in the first direction being at the same height as and being interconnected to the duct runs extending in the second direction, each of the duct runs including duct sections of rectangular shape suspended from the ceiling of the room in spaced relationship thereto and formed of fabricated sound absorbent fibrous board whereby a grid pattern of rectangular sound absorbent duct runs is provided in spaced relationship to the ceiling for absorbing sounds emanating from sources in the room outside of the duct sections, the rectangular duct sections surrounding each open area in the grid pattern forming a pocket for the trapping of sound thereafter absorbed in the sound absorbent fibrous board of the duct sections, and some of the duct sections of the duct runs extending in one of said directions having air distribution openings for distribution of conditioned air into the room.

2. An air distribution duct system as claimed in claim 1 wherein some of the duct sections of the duct runs extending in the other of said directions have air distribution openings for distribution of conditioned air into the room.

3. An air distribution duct system as claimed in claim 1 wherein the air distribution openings are longitudinal slots extending the full length of the respective duct sections.

4. An air distribution duct system as claimed in claim 1 wherein the duct sections are faced on their outer sides with porous decorative glass cloth.

* * * * *